US008014531B2

(12) United States Patent
Toda

(10) Patent No.: US 8,014,531 B2
(45) Date of Patent: Sep. 6, 2011

(54) STEREO/MONAURAL SWITCHING CIRCUIT AND INTEGRATED CIRCUIT HAVING THE SAME

(75) Inventor: Hiroyuki Toda, Hamamatsu (JP)

(73) Assignee: Yamaha Corporation (JP)

( * ) Notice: Subject to any disclaimer, the term of this patent is extended or adjusted under 35 U.S.C. 154(b) by 1125 days.

(21) Appl. No.: 11/621,181

(22) Filed: Jan. 9, 2007

(65) Prior Publication Data

US 2007/0165883 A1 Jul. 19, 2007

(30) Foreign Application Priority Data

Jan. 10, 2006 (JP) ..... 2006-003093

(51) Int. Cl.
*H04H 5/00* (2006.01)

(52) U.S. Cl. ..... 381/11; 381/123

(58) Field of Classification Search ..... 381/80, 381/81, 12, 119, 123, 77, 11, 2, 120
See application file for complete search history.

(56) References Cited

U.S. PATENT DOCUMENTS 3,902,120 A * 8/1975 Dascal et al. ..... 381/309
4,479,235 A * 10/1984 Griffis ..... 381/17
2008/0219480 A1* 9/2008 Hopkins ..... 381/123

FOREIGN PATENT DOCUMENTS

JP 2001-333176 A 11/2001
JP 2003-179992 A 6/2003
JP 2005-109868 A 4/2005
JP 2005-176157 A 6/2005

OTHER PUBLICATIONS

Notification of Reason for Refusal issued in corresponding Japanese Patent Application No. 2006-003093 dated Sep. 7, 2010. English translation provided.

* cited by examiner

*Primary Examiner* — Vivian Chin
*Assistant Examiner* — Con P Tran
(74) *Attorney, Agent, or Firm* — Rossi, Kimms & McDowell LLP

(57) ABSTRACT

An adder mixes an L-channel sound signal and an R-channel sound signal with each other and then outputs a mixed signal. A switching unit performs a switching operation such that, if power is being supplied to loudspeaker amplifiers, the L-channel sound signal and the R-channel sound signal are respectively supplied to the loudspeaker amplifiers, and if power is not being supplied to the loudspeaker amplifier, an output signal of the adder is supplied to the loudspeaker amplifier. A power down control unit forces a loudspeaker amplifier to which power is not supplied and a preamplifier for driving the loudspeaker amplifier to be in a power-down state.

12 Claims, 4 Drawing Sheets

STEREO/MONAURAL SWITCHING CIRCUIT AND INTEGRATED CIRCUIT HAVING THE SAME

BACKGROUND OF THE INVENTION

The present invention relates to a stereo/monaural switching circuit and an integrated circuit, such as a sound generator integrated circuit, which has the stereo/monaural switching circuit and can be mounted in both an apparatus for stereophonic reproduction and an apparatus for monaural reproduction.

In the case of manufacturing an audio apparatus such as a mobile phone, in order to reduce the manufacturing cost, a sound generator LSI (large scale integrated circuit), which can correspond to both of stereophonic reproduction and monaural reproduction, is manufactured and then the sound generator LSI is used to manufacture both an apparatus for stereophonic reproduction and an apparatus for monaural reproduction.

FIG. 4 is a block diagram illustrating an example of the configuration of an output unit of such a sound generator LSI described above. In the sound generator LSI, loudspeaker amplifiers 11 and 12 serve to drive respective loudspeakers (not shown) connected to loudspeaker terminals 31 and 32 with power supplied through power terminals 21 and 22, respectively. The preamplifiers 41 and 42 serve to drive the loudspeaker amplifiers 11 and 12 on the basis of input signals, respectively. In the sound generator LSI, power AVDD is supplied to circuits, such as the preamplifiers 41 and 42, other than the loudspeaker amplifiers 11 and 12, through power terminals provided separately from the power terminals 21 and 22.

Each of the loudspeaker amplifiers 11 and 12 and the preamplifiers 41 and 42 for driving the loudspeaker amplifiers 11 and 12 has an active state in which an input signal is amplified and is then output, and a power-down state in which an amplifying operation is not performed and power consumption is extremely low. Each of the loudspeaker amplifier 11 and the preamplifier 41 located at a stage prior to the loudspeaker amplifier 11 is in the active state when a power down control signal PDL, which is supplied from a host CPU (not shown) located outside the sound generator LSI, has a value of '0' and is in the power-down state when the power down control signal PDL has a value of '1'. In the same manner, each of the loudspeaker amplifier 12 and the preamplifier 42 located at a stage prior to the loudspeaker amplifier 12 is in an active state when the power down control signal PDR supplied from the host CPU has a value of '0' and is in a power-down state when the power down control signal PDR has a value of '1'.

An adder 50 is a circuit that mixes an L-channel sound signal SL and an R-channel sound signal SR with each other, which are supplied from a sound generating unit (not shown) within the sound generator LSI, and then outputs the mixed signal. An analog switch 61 selects an output signal of the adder 50 when a monaural/stereo control signal M/S supplied from the host CPU is '1', and then supplies the output signal of the adder 50 to the preamplifier 41. On the other hand, the analog switch 61 selects the L-channel sound signal SL when the monaural/stereo control signal M/S has a value of '0', and then supplies the L-channel sound signal SL to the preamplifier 41.

Hereinbefore, the configuration of the output unit of the sound generator LSI has been described.

The sound generator LSI may be mounted in both an apparatus for stereophonic reproduction, which is provided with loudspeakers corresponding to two channels of L and R, and an apparatus for monaural reproduction, which is provided with one loudspeaker. In the case in which the sound generator LSI is mounted in the former apparatus for stereophonic reproduction, the loudspeaker terminals 31 and 32 of the sound generator LSI are connected to the L-channel loudspeaker and the R-channel loudspeaker, respectively, and both of the power terminals 21 and 22 are connected to a power supply. Moreover, in the apparatus for stereophonic reproduction, the host CPU provides the monaural/stereo control signal M/S having a signal value of '0' to the sound generator LSI. Then, in the sound generator LSI, the L-channel sound signal output from the sound generating unit is amplified by the preamplifier 41 and the loudspeaker amplifier 11 and the R-channel sound signal is amplified by the preamplifier 42 and the loudspeaker amplifier 12, and thus stereophonic reproduction sounds are output from the loudspeakers corresponding to two channels of L and R. In addition, when sound reproduction is not performed because, for example, there is no sound signal to be reproduced, power down control signals PDL and PDR each having a signal value of '1' are output from the host CPU. As a result, each of the loudspeaker amplifiers 11 and 12 and the preamplifiers 41 and 42 becomes in the power-down state, which allows power consumption of the power supply to be saved.

On the other hand, in the case in which the sound generator LSI is mounted in the apparatus for monaural reproduction, the loudspeaker terminal 31 of the sound generator LSI is connected to a loudspeaker. Moreover, in the apparatus for monaural reproduction, the host CPU provides the monaural/stereo control signal M/S having a signal value of '1' to the sound generator LSI. Then, in the sound generator LSI, a signal, which is obtained by mixing the L-channel sound signal and the R-channel sound signal with each other, output from the adder 50 is amplified by the preamplifier 41 and the loudspeaker amplifier 11, and thus monaural reproduction sounds are output from the loudspeaker connected to the loudspeaker terminal 31. The host CPU causes the power down control signal PDR to have a value of '1' all the time, in order to save the power consumption by causing the loudspeaker amplifier 12 and the preamplifier 42, which are not used, to be in a power-down state. In addition, when the sound reproduction is not performed, the host CPU causes the power down control signal PDL to have a value of '1' so as to cause the loudspeaker amplifier 11 and the preamplifier 41 to be in a power-down state, thereby saving the power consumption.

As described above, when a known sound generator LSI is mounted in the apparatus for stereophonic reproduction, the known sound generator LSI outputs sound signals, which are generated by the sound generating unit, as stereophonic reproduction sounds, and when the known sound generator LSI is mounted in the apparatus for monaural reproduction, the known sound generator LSI outputs sound signals generated by the sound generating unit as monaural reproduction sounds. In addition, when the known sound generator LSI is mounted in the apparatus for monaural reproduction, the known sound generator LSI causes a loudspeaker amplifier and a preamplifier, which are not used, to be in a power-down state, thereby saving the power consumption. However, a host CPU in the apparatus for stereophonic reproduction supplies the monaural/stereo control signal M/S having a signal value of '0' to the sound generator LSI, while a host CPU in the apparatus for monaural reproduction supplies the monaural/stereo control signal M/S having a signal value of '1' to the sound generator LSI. Further, the host CPU in the apparatus for stereophonic reproduction is to perform '0'/'1' switching operation with respect to the power down control signals PDL and PDR in correspondence with whether or not to reproduce a sound, while the host CPU in the apparatus for monaural reproduction is to cause the power down control signal PDR to have a value of '1' all the time and is to perform '0'/'1' switching operation with respect to only the power down control signal PDL in correspondence with whether or not to reproduce a sound. In the known technique described above, since control operations of the host CPU with respect to the sound generator LSI are different between the apparatus for stereophonic reproduction and the apparatus for monaural reproduction, there has been a problem in that a control program stored in a program memory of the host CPU needs to be changed depending on which apparatus the sound generator LSI is mounted.

SUMMARY OF THE INVENTION

The invention has been made in view of the drawbacks inherent in the related art, and it is desirable to provide a stereo/monaural switching circuit, which is capable of automatically performing a switching operation between an apparatus for stereophonic reproduction and an apparatus for monaural reproduction, and an integrated circuit having the stereo/monaural switching circuit.

According to an aspect of the invention, there is provided a stereo/monaural switching circuit including: a determination unit that determines whether or not power is being supplied to at least a second loudspeaker amplifier of a first loudspeaker amplifier and the second loudspeaker amplifier that cause loudspeakers to be driven; a switching unit that performs a switching operation with respect to a transmission path of a sound signal such that, if the determination unit determines that power is being supplied to the second loudspeaker amplifier, the first-channel sound signal and the second-channel sound signal are respectively supplied to the first loudspeaker amplifier and the second loudspeaker amplifier, and if the determination unit determines that power is not being supplied to the second loudspeaker amplifier, an output signal of the mixing unit is supplied to the first loudspeaker amplifier; and a power down control unit that, if the determination unit determines that power is not being supplied to the second loudspeaker amplifier, forces the second loudspeaker amplifier and a circuit for driving the second loudspeaker amplifier to be in a power-down state.

Further, according to another aspect of the invention, there is provided a stereo/monaural switching circuit including: a determination unit that determines whether or not power is being supplied to each of a first loudspeaker amplifier and a second loudspeaker amplifier that cause loudspeakers to be driven; a mixing unit that mixes a first-channel sound signal and a second-channel sound signal with each other and then outputs a mixed signal; a switching unit that performs a switching operation with respect to a transmission path of a sound signal such that, if the determination unit determines that power is being supplied to both the first loudspeaker amplifier and the second loudspeaker amplifier, the first-channel sound signal and the second-channel sound signal are respectively supplied to the first loudspeaker amplifier and the second loudspeaker amplifier, and if the determination unit determines that power is being supplied to only one of the first loudspeaker amplifier and the second loudspeaker amplifier, an output signal of the mixing unit is supplied to the only one loudspeaker amplifier to which power is being supplied; and a power down control unit that, if the determination unit determines that power is not being supplied to the first loudspeaker amplifier or the second loudspeaker amplifier, forces the corresponding loudspeaker amplifier to which power is not being supplied and a circuit for driving the corresponding loudspeaker amplifier to be in a power-down state.

According to the stereo/monaural switching circuit described above, on the basis of a result of a determination on whether or not power is being supplied to a loudspeaker amplifier, it is determined whether stereophonic reproduction is to be performed or monaural reproduction is to be performed, a transmission path of a sound signal corresponding to the stereophonic reproduction or a transmission path of a sound signal corresponding to the monaural reproduction is formed, and a loudspeaker amplifier and a circuit for driving the loudspeaker amplifier, which are not used in the case of the monaural reproduction, are controlled to be forced to be in a power-down state.

Accordingly, if the stereo/monaural switching circuit is mounted in an integrated circuit, such as a sound generator integrated circuit, it is not necessary to change a control operation on the integrated circuit depending on whether the stereophonic reproduction is to be performed or the monaural reproduction is to be performed by the integrated circuit.

DETAILED DESCRIPTION OF PREFERRED EMBODIMENTS

Hereinafter, embodiments of the invention will be described with reference to the accompanying drawings.

First Embodiment

Figure 1:
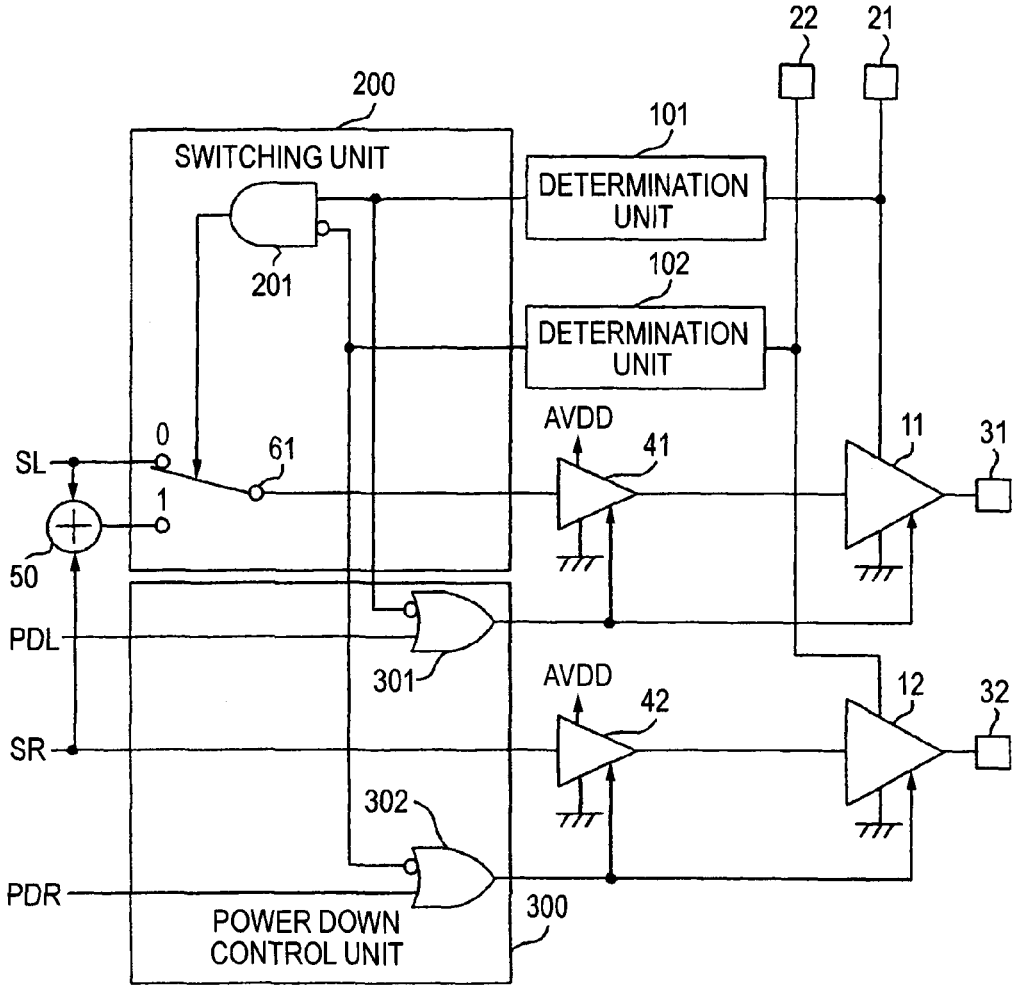
FIG. 1 is a circuit diagram illustrating the configuration of an output unit of a sound generator LSI having a stereo/monaural switching circuit according to a first embodiment of the invention.
Figure 4:
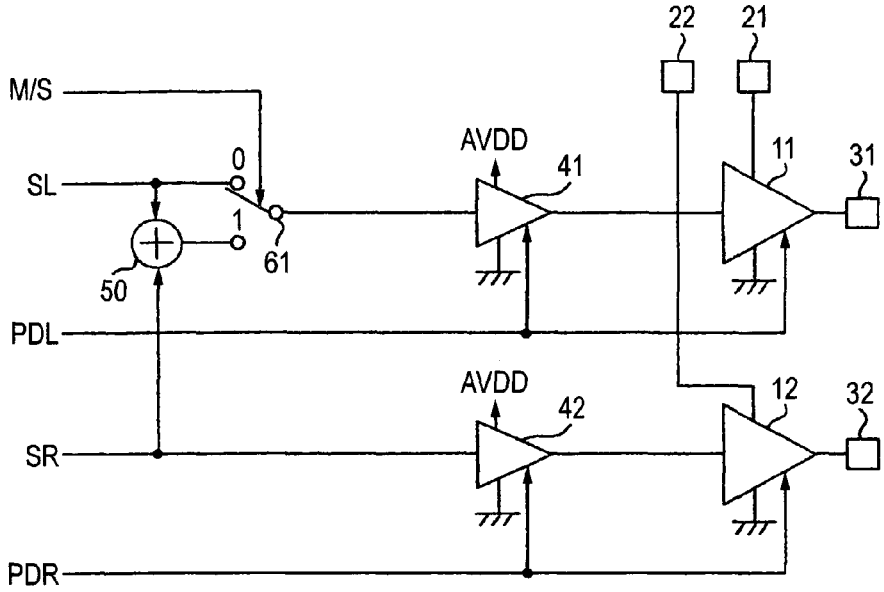
FIG. 4 PRIOR ART
FIG. 4 is a circuit diagram illustrating the configuration of an output unit of a sound generator LSI in the related art.

FIG. 1 is a circuit diagram illustrating the configuration of an output unit of a sound generator LSI having a stereo/monaural switching circuit according to a first embodiment. In addition, in FIG. 1, the same components as in FIG. 4 are denoted by the same reference numerals. Although not shown, in a stage prior to the output unit shown in FIG. 1, a sound generating unit that outputs sound signals corresponding to two channels of L and R is provided. The sound generator LSI is an integrated circuit obtained by mounting the sound generating unit and the output unit shown in FIG. 1 on the same chip.

In the present embodiment, the stereo/monaural switching circuit is configured to include an adder 50, determination unit 101 and 102, a switching unit 200, and a power down control unit 300.

The determination unit 101 is a circuit that outputs a signal having a signal value of '1' while power is being supplied to a loudspeaker amplifier 11 through a power terminal 21 and outputs a signal having a signal value of '0' while power is not being supplied. In addition, the determination unit 102 is a circuit that outputs a signal having a signal value of '1' while power is being supplied to a loudspeaker amplifier 12 through a power terminal 22 and outputs a signal having a signal value of '0' while power is not being supplied.

The switching unit 200 includes an analog switch 61 and an AND gate 201. Here, the AND gate 201 has a high active input terminal and a low active input terminal, and an output signal of the determination unit 101 is supplied to the high active input terminal and an output signal of the determination unit 102 is supplied to the low active input terminal.

The analog switch 61 selects an L-channel sound signal when the output signal of the AND gate 201 has a value of '0' and then supplies the selected L-channel sound signal to a preamplifier 41. On the other hand, the analog switch 61 selects an output signal of the adder 50 when the output signal of the AND gate 201 is '1' and then supplies the selected output signal to the preamplifier 41.

The power down control unit 300 includes OR gates 301 and 302 each having a high active input terminal and a low active input terminal. Here, a power down control signal PDL is supplied from a host CPU (not shown), which is located outside the sound generator LSI, to the high active input terminal of the OR gate 301, and the output signal of the determination unit 101 is supplied to the low active input terminal of the OR gate 301. An output signal of the OR gate 301 is supplied, as a power down control signal, to the preamplifier 41 and the loudspeaker amplifier 11. A power down control signal PDR is supplied from the host CPU to the high active input terminal of the OR gate 302, and the output signal of the determination unit 102 is supplied to the low active input terminal of the OR gate 302. An output signal of the OR gate 302 is supplied, as a power down control signal, to the preamplifier 42 and the loudspeaker amplifier 12.

Hereinbefore, the configuration of the present embodiment has been described.

Next, an operation of the present embodiment will be described. In the case when the sound generator LSI is mounted in an apparatus for stereophonic reproduction, both power terminals 21 and 22 are connected to a power supply, so that power is supplied to both the loudspeaker amplifiers 11 and 12. Accordingly, an output signal of each of the determination units 101 and 102 has a value of '1', and an output signal of the AND gate 201 has a value of '0'.

As a result, an L-channel sound signal SL is selected by the analog switch 61. The L-channel sound signal selected by the analog switch 61 is amplified by the preamplifier 41 and the loudspeaker amplifier 11 and is then output from a loudspeaker terminal 31. On the other hand, an R-channel sound signal is amplified by the preamplifier 42 and the loudspeaker amplifier 12 and is then output from a loudspeaker terminal 32. Thus, stereophonic reproduction sounds are output from loudspeakers, which correspond to two channels of L and R, connected to the loudspeaker terminals 31 and 32.

In addition, since both the output signals of the determination units 101 and 102 have values of '1', the power down control signal PDL supplied from the host CPU is supplied to the preamplifier 41 and the loudspeaker amplifier 11 through the OR gate 301, and the power down control signal PDR is supplied to the preamplifier 42 and the loudspeaker amplifier 12 through the OR gate 302, thereby performing a power down control in correspondence with whether a sound is to be reproduced or not.

On the other hand, in the case when the sound generator LSI is mounted in an apparatus for monaural reproduction, only the power terminal 21 is connected to the power supply, so that power is supplied to only the loudspeaker amplifier 11. Since the power terminal 22 is not connected to the power supply, power is not supplied to the loudspeaker amplifier 12. Thus, since an output signal of the determination unit 101 has a value of '1' and an output signal of the determination unit 102 has a value of '0', an output signal of the AND gate 201 has a value of '1'.

Accordingly, a sound signal output from the adder 50, which is obtained by mixing the L-channel sound signal SL and the R-channel sound signal SR with each other, is selected by the analog switch 61. The sound signal selected by the analog switch 61 is amplified by the preamplifier 41 and the loudspeaker amplifier 11 and is then output from the loudspeaker terminal 31. Thus, monaural reproduction sounds are output from a loudspeaker connected to the loudspeaker terminal 31.

In addition, since the output signal of the determination unit 102 has a value of '0', the OR gate 302 supplies a power down control signal, which has a signal value of '1' all the time, to the preamplifier 42 and the loudspeaker amplifier 12, regardless of a level of the power down control signal PDL supplied from the host CPU. As a result, the preamplifier 42 and the loudspeaker amplifier 12 are always in a power-down state.

In addition, since the output signal of the determination unit 101 has a value of '1', the power down control signal PDL from the host CPU is supplied to the preamplifier 41 and the loudspeaker amplifier 11 through the OR gate 301. Thus, for the preamplifier 41 and the loudspeaker amplifier 11, a power down control reflecting the power down control signal PDL from the host CPU is performed.

As described above, in the stereo/monaural switching circuit according to the present embodiment, a switching operation on whether the L-channel sound signal is to be supplied as a sound signal to the preamplifier 41 or the output signal of the adder 50 is to be supplied as the sound signal to the preamplifier 41 is automatically performed on the basis of whether power is being supplied to the loudspeaker amplifiers 11 and 12 or not. Accordingly, the host CPU does not need to output the monaural/stereo control signal M/S, unlike in the known technique described above. Further, in the present embodiment, in the case when the sound generator LSI is mounted in the apparatus for monaural reproduction and thus power is not supplied to the loudspeaker amplifier 12, even if the host CPU outputs the power down control signals PDL and PDR in consideration of stereophonic reproduction, the stereo/monaural switching circuit uses only the power down control signal PDL so as to perform a power down control for the preamplifier 41 and the loudspeaker amplifier 11. Accordingly, the preamplifier 42 and the loudspeaker amplifier 12 are forced to be always in a power-down state. Thus, in both the case when the sound generator LSI is mounted in the apparatus for stereophonic reproduction and the case when the sound generator LSI is mounted in the apparatus for monaural reproduction, the control of the host CPU with respect to the sound generator LSI can be performed in the same manner. As a result, it is possible to reduce the entire cost when manufacturing the apparatus for stereophonic reproduction and the apparatus for monaural reproduction.

Second Embodiment

Figure 2:
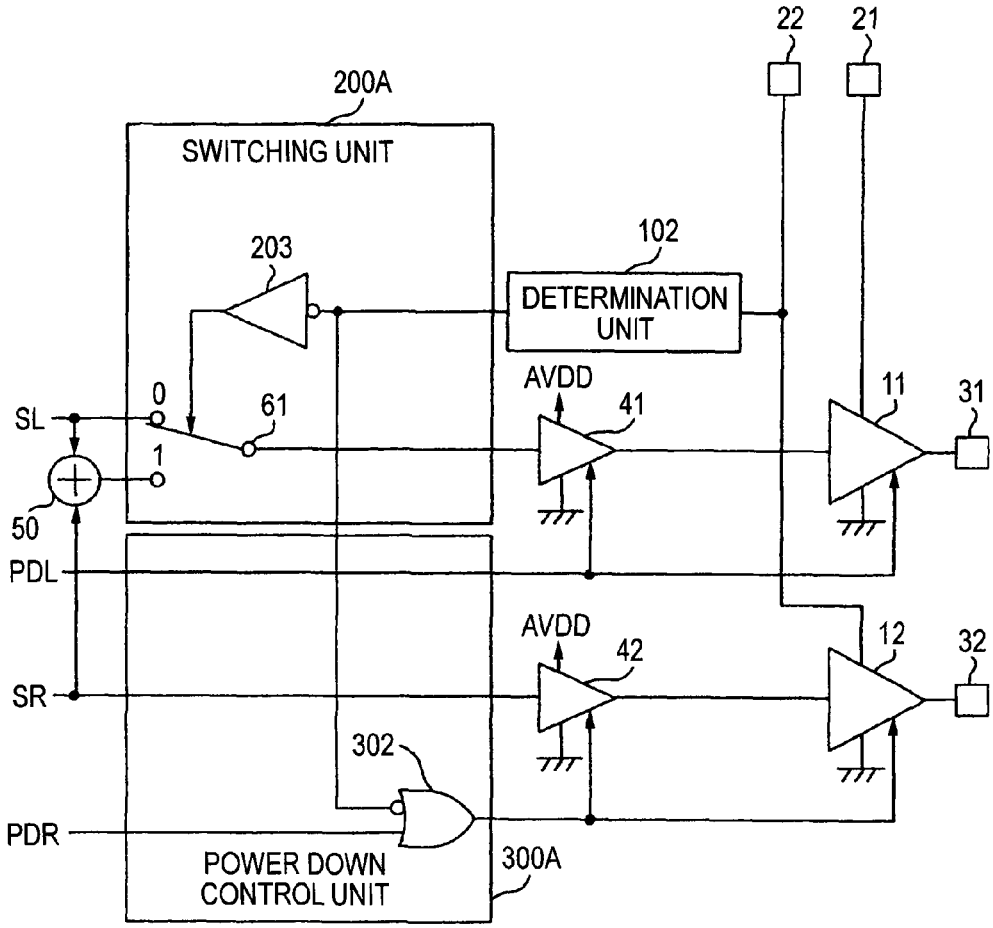
FIG. 2 is a circuit diagram illustrating the configuration of an output unit of a sound generator LSI having a stereo/monaural switching circuit according to a second embodiment of the invention.

FIG. 2 is a circuit diagram illustrating the configuration of an output unit of a sound generator LSI having a stereo/monaural switching circuit according to a second embodiment. In this stereo/monaural switching circuit, a determination unit 102 determines only whether or not power is supplied to a loudspeaker amplifier 12. In the present embodiment, the determination unit 101 described in the first embodiment is not provided. In addition, a switching unit 200A in the present embodiment is configured to include an inverter 203 instead of the AND gate 201 of the switching unit 200 in the first embodiment. Moreover, a power down control unit 300A in the present embodiment has a configuration in which a power down control signal PDL from a host CPU is directly supplied to the preamplifier 41 and the loudspeaker amplifier 11 by removing the OR gate 301 from the power down control unit 300 in the first embodiment.

The inverter 203 inverts an output signal of the determination unit 102 and then outputs the inverted signal. While power is being supplied to the loudspeaker amplifier 12, the output signal of the determination unit 102 has a value of '1' and the output signal of the inverter 203 has a value of '0'. In this case, the L-channel sound signal is selected by an analog switch 61 and is then supplied to the preamplifier 41. In addition, the power down control signal PDL from the host CPU is supplied to the preamplifier 41 and the loudspeaker amplifier 11, and a power down control signal PDR is supplied to the preamplifier 42 and the loudspeaker amplifier 12. On the other hand, while the power is not being supplied to the loudspeaker amplifier 12, the output signal of the determination unit 102 has a value of '1' and the output signal of the inverter 203 has a value of '0'. In this case, an output signal of an adder 50 is selected by the analog switch 61 and is then supplied to the preamplifier 41. In addition, each of the preamplifier 42 and the loudspeaker amplifier 12 is always in a power-down state, regardless of a level of the power down control signal PDR.

The present embodiment is advantageous in that the same effects as in the first embodiment can be obtained by using a smaller number of elements than that in the first embodiment.

Third Embodiment

Figure 3:
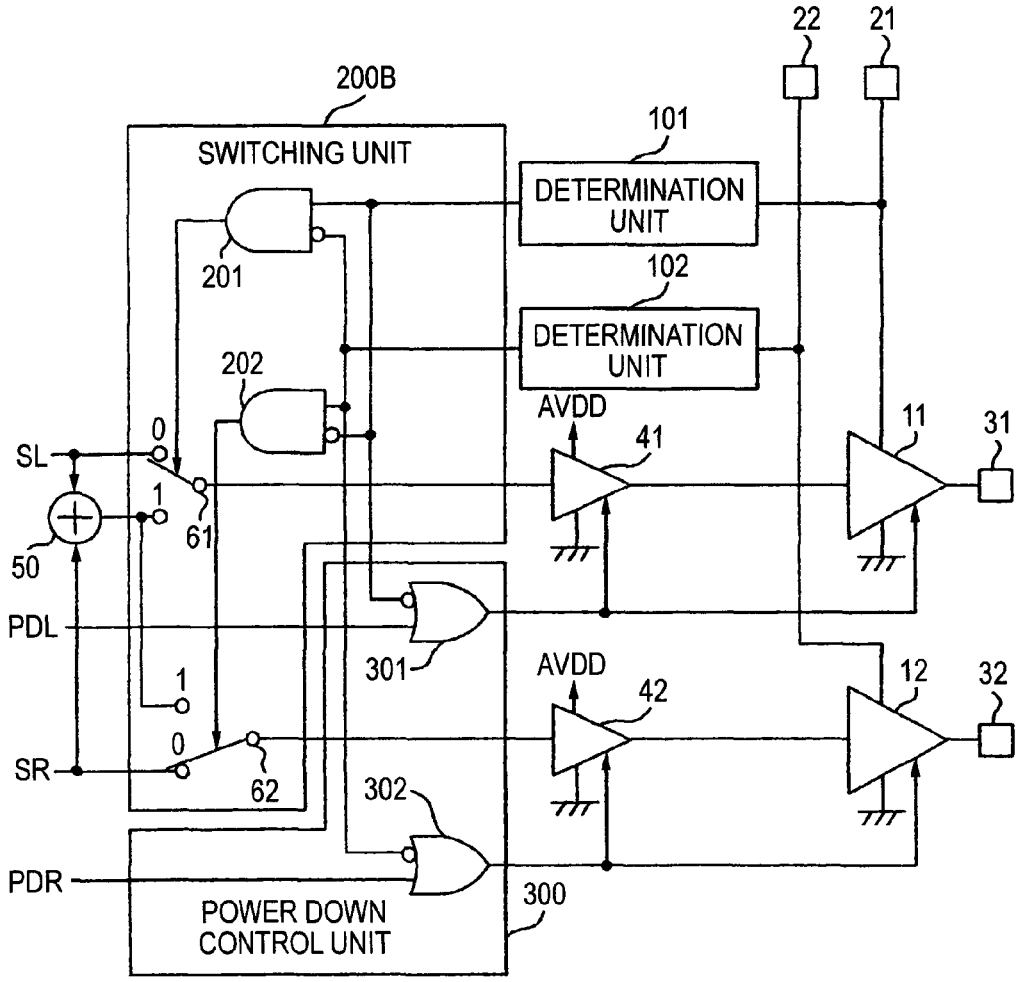
FIG. 3 is a circuit diagram illustrating the configuration of an output unit of a sound generator LSI having a stereo/monaural switching circuit according to a third embodiment of the invention.

FIG. 3 is a circuit diagram illustrating the configuration of an output unit of a sound generator LSI having a stereo/monaural switching circuit according to a third embodiment. In this stereo/monaural switching circuit, a switching unit 200B is provided instead of the switching unit 200 in the first embodiment. The switching unit 200B has a configuration obtained by additionally providing an AND gate 202 and an analog switch 62 in the switching unit 200. The AND gate 202 outputs '1' only when an output signal of a determination unit 101 has a value of '0' and an output signal of a determination unit 102 has a value of '1'. In other cases, the AND gate 202 outputs '0'. The analog switch 62 selects an R-channel sound signal when the output signal of the AND gate 202 has a value of '0' and then supplies the selected R-channel sound signal to a preamplifier 42. On the other hand, the analog switch 62 selects an output signal of an adder 50 when the output signal of the AND gate 202 has a value of '1' and then supplies the selected output signal to the preamplifier 42.

In the case when the sound generator LSI is mounted in an apparatus for stereophonic reproduction, power is supplied to both loudspeaker amplifiers 11 and 12. In this case, each of the output signals of the determination units 101 and 102 has a value of '1', and each of the output signals of the AND gates 201 and 202 has a value of '0'. As a result, the L-channel sound signal is selected by an analog switch 61 and is then supplied to the preamplifier 41, and the R-channel sound signal is selected by the analog switch 62 and is then supplied to the preamplifier 42. In addition, a power down control signal PDL from a host CPU is supplied to the preamplifier 41 and the loudspeaker amplifier 11 through the OR gate 301, and a power down control signal PDR is supplied to the preamplifier 42 and the loudspeaker amplifier 12 through the OR gate 302. Thus, in the sound generator LSI, stereophonic reproduction and control corresponding to the stereophonic reproduction are realized.

In the present embodiment, in the case when the sound generator LSI is mounted in an apparatus for monaural reproduction, the loudspeaker amplifier 11 may be used for the monaural reproduction or the loudspeaker amplifier 12 may be used for the monaural reproduction. In the former case in which the loudspeaker amplifier 11 is used for the monaural reproduction, a loudspeaker is connected to a loudspeaker terminal 31 and a power supply is connected to only a power terminal 21. In this case, an output signal of the determination unit 101 has a value of '1', an output signal of the determination unit 102 has a value of '0', an output signal of the AND gate 201 has a value of '1', and an output signal of the AND gate 202 has a value of '0'. Since the output signal of the AND gate 201 has a value of '1', an output signal of the adder 50 is selected by the analog switch 61 and is then supplied to the preamplifier 41, and thus monaural reproduction sounds are output from the loudspeaker connected to the loudspeaker terminal 31. In addition, since the output signal of the determination unit 101 has a value of '1', the power down control signal PDL from the host CPU is supplied to the preamplifier 41 and the loudspeaker amplifier 11 through the OR gate 301. On the other hand, since the output signal of the AND gate 202 has a value of '0', the R-channel sound signal is selected by the analog switch 62 and is then supplied to the preamplifier 42. However, since the output signal of the determination unit 102 has a value of '0', the preamplifier 42 and the loudspeaker amplifier 12 are force to be in a power-down state.

In the latter case in which the loudspeaker amplifier 12 is used for the monaural reproduction, a loudspeaker is connected to a loudspeaker terminal 32 and a power supply is connected to only a power terminal 22. In this case, the output signal of the determination unit 101 has a value of '0', the output signal of the determination unit 102 has a value of '1', the output signal of the AND gate 201 has a value of '0', and the output signal of the AND gate 202 has a value of '1'. Since the output signal of the AND gate 202 has a value of '1', the output signal of the adder 50 is selected by the analog switch 62 and is then supplied to the preamplifier 42, and thus monaural reproduction sounds are output from the loudspeaker connected to the loudspeaker terminal 32. In addition, since the output signal of the determination unit 102 has a value of '1', the power down control signal PDR from the host CPU is supplied to the preamplifier 42 and the loudspeaker amplifier 12 through the OR gate 302. On the other hand, since the output signal of the AND gate 201 has a value of '0', the L-channel sound signal is selected by the analog switch 61 and is then supplied to the preamplifier 41. However, since the output signal of the determination unit 101 has a value of '0', the preamplifier 41 and the loudspeaker amplifier 11 are force to be in a power-down state.

As described above, according to the present embodiment, it is possible to obtain the same effects as in the first embodiment. Furthermore, in the case when the sound generator LSI is mounted in the apparatus for monaural reproduction, the present embodiment is advantageous in that it is possible to arbitrarily select which one of the loudspeaker amplifiers 11 and 12 will be used for the monaural reproduction.

While the first to third embodiments of the invention have been described, it may be possible to consider other embodiments of the invention. For example, in the embodiments described above, the power down control with respect to a loudspeaker amplifier and a preamplifier, which is located at a stage prior to the loudspeaker amplifier, is performed by using a power down control signal; however, the power down control may be further performed even for circuits located at stages prior to the preamplifier. Furthermore, in the embodiments described above, the stereo/monaural switching circuit is mounted in the sound generator LSI; however, the stereo/monaural switching circuit according to each of the embodiments may be mounted in an integrated circuit, which is used for the stereo/monaural reproduction, other than the sound generator LSI. Furthermore, in the embodiments described above, the host CPU is an external unit that is provided outside the sound generator LSI; however, the stereo/monaural switching circuit according to each of the embodiments may be mounted in a sound generator LSI having a circuit functioning as a host CPU.

What is claimed is:

1. A stereo/monaural switching circuit comprising:

first and second loudspeaker amplifiers that drive loudspeakers, respectively;

a determination unit that determines whether or not power is being supplied to at least the second loudspeaker amplifier;

a mixing unit that mixes a first-channel sound signal and a second-channel sound signal with each other and outputs a mixed signal;

a switching unit that performs a switching operation with respect to a transmission path of a sound signal so that, when the determination unit determines that power is being supplied to the second loudspeaker amplifier, the first-channel sound signal and the second-channel sound signal are respectively supplied to the first loudspeaker amplifier and the second loudspeaker amplifier, and when the determination unit determines that power is not being supplied to the second loudspeaker amplifier, an output signal of the mixing unit is supplied to the first loudspeaker amplifier for monaural reproduction; and a power down control unit that, if the determination unit determines that power is not being supplied to the second loudspeaker amplifier, forces the second loudspeaker amplifier and a circuit for driving the second loudspeaker amplifier to be in a power-down state.

2. The stereo/monaural switching circuit according to claim 1, wherein the switching unit includes a first logical circuit to which an output of the determination unit is input and a switching element controlled by the first logical circuit, one end of the switching element being connected to an input of the first loudspeaker amplifier, and the other end being selectively connected to an input of the first-channel sound signal and an output of the mixing unit, the power down control unit includes a second logical circuit to which the output of the determination unit and a power down control signal are input, when the output of the determination unit indicates that power is being supplied to the second loudspeaker amplifier, the first logical circuit controls the switching element to connect the input of the first loudspeaker amplifier to the input of the first-channel sound signal, and when the output of the determination unit indicates that power is not being supplied to the second loudspeaker amplifier, the first logical circuit controls the switching element to connect the input of the first loudspeaker amplifier to the output of the mixing unit, and when the output of the determination unit indicates that power is not being supplied to the second loudspeaker amplifier or when the power down control signal indicates power down, the second logical circuit forces the second loudspeaker amplifier and the circuit for driving the second loudspeaker amplifier to be in a power-down state.

3. The stereo/monaural switching circuit according to claim 2, wherein the first logical circuit comprises an inverter, and the second logical circuit comprises an OR gate including a low active input terminal to which the output of the determination unit is input and a high active input terminal to which the power down control signal is input.

4. The stereo/monaural switching circuit according to claim 1, wherein the first and second loudspeaker amplifiers include power terminals which are separated from each other and connected to power supply, respectively.

5. An integrated circuit comprising:

a sound output unit that outputs a first-channel sound signal and a second-channel sound signal; and the stereo/monaural switching circuit according to claim 1, wherein the sound output unit and the stereo/monaural switching circuit are mounted on the same chip.

6. A stereo/monaural switching circuit comprising:

first and second loudspeaker amplifiers that drive loudspeakers, respectively;

a determination unit that determines whether or not power is being supplied to each of the first and second loudspeaker amplifiers;

a mixing unit that mixes a first-channel sound signal and a second-channel sound signal with each other and outputs a mixed signal;

a switching unit that performs a switching operation with respect to a transmission path of a sound signal so that, when the determination unit determines that power is being supplied to both the first and second loudspeaker amplifiers, the first-channel sound signal and the second-channel sound signal are respectively supplied to the first and second loudspeaker amplifiers, and when the determination unit determines that power is being supplied to only one of the first and second loudspeaker amplifiers, an output signal of the mixing unit is supplied to the only one loudspeaker amplifier to which power is being supplied for monaural reproduction; and a power down control unit that, when the determination unit determines that power is not being supplied to the first or second loudspeaker amplifier, forces the corresponding loudspeaker amplifier to which power is not being supplied and a circuit for driving the corresponding loudspeaker amplifier to be in a power-down state.

7. The stereo/monaural switching circuit according to claim 6, wherein the determination unit includes a first determination unit that determines whether or not power is being supplied to the first loudspeaker amplifier, and a second determination unit that determines whether or not power is being supplied to the second loudspeaker amplifier, the switching unit includes a first logical circuit to which outputs of the first and second determination units are input and a switching element controlled by the first logical circuit, one end of the switching element being connected to an input of the first loudspeaker amplifier, and the other end being selectively connected to an input of the first-channel sound signal and an output of the mixing unit, the power down control unit includes a second logical circuit to which the output of the first determination unit and a first power down control signal are input, and a third logical circuit to which the output of the second determination unit and a second power down control signal are input, when the output of the first determination unit indicates that power is being supplied to the first loudspeaker amplifier and the output of the second determination unit indicates that power is not being supplied to the second loudspeaker amplifier, the first logical circuit controls the switching element to connect the input of the first loudspeaker amplifier to the output of the mixing unit, when the output of the first determination unit indicates that power is not being supplied to the first loudspeaker amplifier or when the first power down control signal indicates power down, the second logical circuit forces the first loudspeaker amplifier and a circuit for driving the first loudspeaker amplifier to be in a power-down state, and when the output of the second determination unit indicates that power is not being supplied to the second loudspeaker amplifier or when the second power down control signal indicates power down, the third logical circuit forces the second loudspeaker amplifier and the circuit for driving the second loudspeaker amplifier to be in a power-down state.

8. The stereo/monaural switching circuit according to claim 7, wherein the first logical circuit comprises an AND gate including a high active input terminal to which the output of the first determination unit is input and a low active input terminal to which the output of the second determination unit is input, the second logical circuit comprises an OR gate including a low active input terminal to which the output of the first determination unit is input and a high active input terminal to which the first power down control signal is input, and the third logical circuit comprises an OR gate including a low active input terminal to which the output of the second determination unit is input and a high active input terminal to which the second power down control signal is input.

9. The stereo/monaural switching circuit according to claim 6, wherein the determination unit includes a first determination unit that determines whether or not power is being supplied to the first loudspeaker amplifier, and a second determination unit that determines whether or not power is being supplied to the second loudspeaker amplifier, the switching unit includes: a first logical circuit to which outputs of the first and second determination units are input; a second logical circuit to which the outputs of the first and second determination units are input; a first switching element controlled by the first logical circuit, one end of the first switching element being connected to an input of the first loudspeaker amplifier, and the other end being selectively connected to an input of the first-channel sound signal and an output of the mixing unit; and a second switching element controlled by the second logical circuit, one end of the second switching element being connected to an input of the second loudspeaker amplifier, and the other end being selectively connected to an input of the second-channel sound signal and an output of the mixing unit, the power down control unit includes a third logical circuit to which the output of the first determination unit and a first power down control signal are input, and a fourth logical circuit to which the output of the second determination unit and a second power down control signal are input, when the output of the first determination unit indicates that power is being supplied to the first loudspeaker amplifier and the output of the second determination unit indicates that power is not being supplied to the second loudspeaker amplifier, the first logical circuit controls the first switching element to connect the input of the first loudspeaker amplifier to the output of the mixing unit, when the output of the first determination unit indicates that power is not being supplied to the first loudspeaker amplifier and the output of the second determination unit indicates that power is being supplied to the second loudspeaker amplifier, the second logical circuit controls the second switching element to connect the input of the second loudspeaker amplifier to the output of the mixing unit, when the output of the first determination unit indicates that power is not being supplied to the first loudspeaker amplifier or when the first power down control signal indicates power down, the third logical circuit forces the first loudspeaker amplifier and a circuit for driving a first loudspeaker amplifier to be in a power-down state, and when the output of the second determination unit indicates that power is not being supplied to the second loudspeaker amplifier or when the second power down control signal indicates power down, the fourth logical circuit forces the first loudspeaker amplifier and a circuit for driving a first loudspeaker amplifier to be in a power-down state.

10. The stereo/monaural switching circuit according to claim 9, wherein the first logical circuit comprises an AND gate including a high active input terminal to which the output of the first determination unit is input and a low active input terminal to which the output of the second determination unit is input, the second logical circuit comprises an AND gate including a high active input terminal to which the output of the second determination unit is input and a low active input terminal to which the output of the first determination unit is input, the third logical circuit comprises an OR gate including a low active input terminal to which the output of the first determination unit is input and a high active input terminal to which the first power down control signal is input, and the fourth logical circuit comprises an OR gate including a low active input terminal to which the output of the second determination unit is input and a high active input terminal to which the second power down control signal is input.

11. The stereo/monaural switching circuit according to claim 6, wherein the first and second loudspeaker amplifiers include power terminals which are separated from each other and connected to power supply, respectively.

12. An integrated circuit comprising:

a sound output unit that outputs a first-channel sound signal and a second-channel sound signal; and the stereo/monaural switching circuit according to claim 6, wherein the sound output unit and the stereo/monaural switching circuit are mounted on the same chip.

* * * * *